US007749045B1

(12) United States Patent
Namanny et al.

(10) Patent No.: US 7,749,045 B1
(45) Date of Patent: Jul. 6, 2010

(54) GLITCH-FREE SYSTEM IN MINIATURE RACING CAR SYSTEMS, AND METHOD OF USE

(76) Inventors: Kerry T. Namanny, 1500 SW. 7th St., Atlantic, IA (US) 50022; Keith E. Namanny, 1500 SW. 7th, Atlantic, IA (US) 50022; Kenneth D. Namanny, 1500 SW. 7th, Atlantic, IA (US) 50022; Barrett D. Moser, 11121 Obee Rd., Whitehouse, OH (US) 43571

( * ) Notice: Subject to any disclaimer, the term of this patent is extended or adjusted under 35 U.S.C. 154(b) by 1062 days.

(21) Appl. No.: 11/130,071

(22) Filed: May 16, 2005

Related U.S. Application Data

(60) Provisional application No. 60/572,990, filed on May 21, 2004.

(51) Int. Cl.
*A63H 30/00* (2006.01)

(52) U.S. Cl. ..... 446/454; 463/6

(58) Field of Classification Search ..... 446/454–456; 463/6; 180/167
See application file for complete search history.

(56) References Cited

U.S. PATENT DOCUMENTS 3,587,100 A * 6/1971 Doremus et al. ..... 463/6
4,213,270 A 7/1980 Oda ..... 46/254
4,334,221 A 6/1982 Rosenhagen et al. ... 340/825.72
4,390,877 A 6/1983 Curran ..... 340/825.72
5,184,694 A * 2/1993 Magrath et al. ..... 180/167
5,216,337 A 6/1993 Orton et al. ..... 318/16
5,218,276 A 6/1993 Yeom et al. ..... 318/16
5,452,901 A 9/1995 Nakada et al. ..... 273/310
5,499,388 A 3/1996 Song ..... 455/62
5,501,455 A * 3/1996 Hirata et al. ..... 463/61
5,577,154 A 11/1996 Orton ..... 388/811
5,800,263 A * 9/1998 Hayashida et al. ..... 463/6
5,885,159 A 3/1999 De Angelis ..... 463/39
6,139,399 A 10/2000 De Angelis ..... 446/484
6,497,608 B2 12/2002 Ho et al. ..... 446/456
6,661,351 B1 12/2003 Matsushiro ..... 340/825.62

* cited by examiner

*Primary Examiner*—Peter D.ungBa Vo
*Assistant Examiner*—Alex F. R. P. Rada, II
(74) *Attorney, Agent, or Firm*—James D. Welch

(57) ABSTRACT

A system and method of conditioning acceleration signals and/or preventing "glitch" actions due to spurious signals, and/or causing termination a competition, and/or disabling a specific contestant in a competition involving remote controlled miniature race vehicles.

6 Claims, 3 Drawing Sheets

GLITCH-FREE SYSTEM IN MINIATURE RACING CAR SYSTEMS, AND METHOD OF USE

This Application claims benefit of Provisional Application Ser. No. 60/572,990 Filed May 21, 2004.

TECHNICAL AREA

The disclosed invention relates to control of remote controlled vehicles, such as miniature racing cars. More particularly the disclosed invention is a system and method of overcoming "glitch" actions as a result of spurious signals when said remote controlled vehicles are waiting for a control signal.

BACKGROUND

It is known to provide a plurality of miniature race cars on a track and remotely control said miniature race cars individually in a competition. Briefly each participant is provided a controller which remotely controls steering and acceleration of one of the plurality of miniature race cars.

Conventionally, practice has been, when the remotely controlled miniature race cars are not actually in a competition, but are waiting for a competition to start, that the controllers which provide signals to the cars are disabled. That means no definite control signal is sent to the remotely controlled miniature race cars. In this condition a "Glitch" has been found to develop wherein a miniature race car receives a spurious signal causing it to move forward or backward when the intent is that it remain motionless.

A Search of Patents has provided:

U.S. Pat. No. 5,577,154 to Orton describes a system in which a speed controller can be set to respond differently to a signal to case an incremental increase in speed, such that near a neutral set-point sensitivity is reduced. It is noted that control is not disabled near the neutral set-point until a signal from an operator enables an acceleration control.

U.S. Pat. No. 5,499,388 to Song, describes a method and system for scanning frequencies to identify a clear channel, and then locking a transmitter and receiver in a model aircraft, onto said clear channel to enable remote control of the model aircraft thereover.

U.S. Pat. No. 6,661,351 to Matsushiro describes system and method for assigning a single identification to a pair of a plurality of transmitters and remote control cars. The transmitter transmits a radio wave signal embodying command signal defining movement of a target car and identification indicating the target car.

U.S. Pat. No. 6,497,608 to Ho et al., describes a toy car comprising radio controlled drive and camera systems.

U.S. Pat. No. 6,338,664 to Wong provides a toy car and remote controller which comprises a toggle switch to enable two sets of vehicle functions.

U.S. Pat. No. 6,139,399 to DeAngelis describes a toy vehicle comprising means for maintaining operative voltage levels by controlling pulse widths of energy modulations.

U.S. Pat. No. 5,885,159 to DeAngelis describes a system of toy vehicles and pads which can remotely control the operation of more than one thereof.

U.S. Pat. No. 5,452,901 describes synchronized control applied to a system comprising a plurality of remote control toys, controlled by a plurality of transmitters, some of which can operate at the same wavelength.

U.S. Pat. No. 5,218,276 to Yeon et al., describes another system allowing use of a frequency which is shared by a large number of people, in remote control of d.c. motors.

U.S. Pat. No. 5,216,337 describes a radio controlled speed control system with audible feedback without the requirement of an audible transducer. The system switches between on and off states between first and second battery lines and a motor line.

U.S. Pat. No. 5,043,640 to Orton describes a remote speed controller system including means for producing an output signal related to the amount of current supplied to a motor, and a test point arrangement for coupling a read-out device for reading the output signal.

U.S. Pat. No. 4,390,877 to Curran describes a remote control system in which control signals are transmitted to receivers in a number of cars which are located on a conductive track.

U.S. Pat. No. 4,334,221 describes a multi-vehicle, multi-controller radio control system which uses coded transmitted bursts which individual vehicles recognize as meant therefore or not.

U.S. Pat. No. 4,213,270 describes a radio controlled wheel toy in which separate motors control one of two front wheels, and one of two oppositely positioned rear wheels, the purpose being to effect turning of the vehicle based on different speeds of the motors.

U.S. Pat. No. 3,587,100 describes a signal transmission and receiving system including means to carrier modulation means to multiplex a plurality of carriers, in combination with means to selectively receive and demodulate a chosen carrier to provide control to a specific receiving means.

U.S. Pat. No. 6,604,996 to the Inventors herein, is disclosed as it describes a method of competition utilizing miniature radio controlled cars.

Need remains for a system and method comprising a control means and method of its application, such that a "Glitch" condition, wherein a miniature race car receives a spurious signal causing it to move forward or backward when the intent is that it remain motionless, is prevented.

DISCLOSURE OF THE INVENTION

The present invention assumes the presence of a plurality of miniature race cars, each of which comprises means for enabling remote control thereof. Typical practice provides that each of the miniature race cars is controlled by a separate control means, and that a competition be conducted by allowing a plurality of the miniature race cars to compete, under the control of a plurality of operators. Prior to the start of such a competition the miniature radio controlled race cars are meant to remain motionless. To achieve this, conventional practice has been that all control signals thereto are disabled. The present invention teaches that only a specific control signal will be disabled, that being the throttle control signal which when enabled controls acceleration of a car. This maintains signal contact from the remote control system associated with each miniature remote controlled car, but the signal to a miniature remote control car is incapable of causing it to move. As signal is still transmitted to the miniature remote controlled cars, they are substantially immune to receipt of spurious signals that cause "glitches", (eg. a miniature remote controlled car moving when a signal to do so is not received thereby). The Inventor's have likened the effect to that of a "clutch", which is under the control of a master controller.

A present invention method of conducting a competition comprising the steps of:

a) providing a plurality of remotely controlled miniature race cars, each having an individual controller associated therwith, which associated controllers are capable of sending signals to control both steering and acceleration of an associated miniature race car;

b) from a master control means sending the individual controllers a signal which, while the miniature race cars are in a starting position, disables acceleration control but maintains communication between the controller and its associated miniature race car;

c) upon the start of a competition enabling said acceleration control in each controller-miniature race car combination from said master control means;

to the end that during the time in which a miniature race car is in a starting position it does not move forward or backward because of receipt of a spurious signal.

Another present invention method of conducting a competition can comprise the steps of:

a) providing a plurality of remotely controlled miniature race cars, each having an individual controller associated therewith, which associated controllers are capable of sending signals to control both steering and acceleration of an associated miniature race car;

b) providing a master control means sending the individual controllers a signal which can disable acceleration control while allowing continued communication between the controller and its associated miniature race car;

c) enabling said acceleration control in each controller-miniature race car combination from said master control means such that a competition can take place;

d) during said competition disabling the acceleration control of at least one controller, to the end that the miniature race car associated therewith is disabled.

Either method can further comprise, at the end of the competition, automatically disabling the acceleration control in each controller-miniature race car combination.

The present invention also recognizes that an accelerator control can be, functionally, a spring biased potentiometer which when operated outputs a voltage signal, and which when released from control returns to a position wherein ideally no voltage is output therefrom. In practice when the potentiometer control is released, the potentiometer output voltage returns to near, but not always exactly zero and that signal can cause miniature racing cars to "Glitch". The present invention then further comprises the provision and use of potentiometers which have "dead regions" around zero, such that when control is released the resulting output is zero. That is, for instance, if a conventional potentiometer can provide from −50 to +50 volts continuous output, the present invention potentiometer can provide −50 to −10 and +10 to +50 volts. That is, between −10 and +10 volts the potentiometer can not provide output. This can be effected by, for instance, coating a region of the potentiometer wire or composition or the like with insulator in the region thereof which would otherwise provide −10 to +10 volts. More generally this can be expressed as:

in a controller-miniature race car combination which controller comprises potentiometer means for providing an acceleration signal, a potentiometer which has a "dead-region" such that voltage is output thereby between −X to −Y and between +Y to +Z, where Y is greater than zero;

and where between −Y and +Y the potentiometer outputs substantially Zero Volts. It is noted that −X and −Y can be both be (0.0) volts, such that a dead-region exists between (0.0) and +Y volts when +Z volts is applied, (where +Z>+Y).

Further, the master control means can include a timer which, upon operation to enable acceleration control in each pair of controller-miniature race car, begins to count down to the end of the competition. For instance, if the competition is to last ten minutes, at the end of said 10 minutes the acceleration control in the controller in each controller-miniature race car combination, will automatically be disabled. It is also possible temporarily interrupt a race when, for instance, a miniature race car overturns. When this is done, the timer is frozen, and restarts when the race is restarted.

Another specific example, a controller can comprise a conventional potentiometer means for providing an acceleration signal corresponding to an input voltage between a Lower Voltage (LV), (eg. zero (0.0)), and some upper positive voltage (VU), (eg. +5 or more volts). Instead of applying a potentiometer which has a "dead-region" as described above, the output voltage from the potentiometer can be fed into a logic performing means, (eg. a properly programmed microprocessor), which responds to a voltage between 0.0 and the upper +V by passing the input voltage straight through below and above some +V1 and +V2 values, (where VU>V2>V1), while providing a constant output voltage when the voltage input thereto is between +V1 and +V2. For practical insight, the voltage output between a Lower value (eg. 0.0), and +V1 might correspond to reverse or forward acceleration of a miniature race car, and the voltage between V2 and VU to forward or reverse acceleration, respectively, while a voltage of between V1 and V2 corresponds to a condition of no acceleration. As described above, in this modified embodiment, the master control means preferably includes means for disabling all acceleration controlling output voltage when desired, such as before and after a race, and when a miniature race car overturns or is being operated recklessly by a user. The present invention can then be described as a controller-miniature race vehicle combination, which controller comprises potentiometer means for providing an acceleration signal and a logic means for receiving said acceleration signal and producing a modified version thereof. In more detail, the controller-miniature race vehicle combination can provide that input voltage to the logic means is passed through directly when said input voltage is between a lower voltage LV and a voltage V1, or between a voltage V2 and an upper voltage UV, but is converted to a different, typically constant, voltage output thereby when the input to the logic means is between V1 and V2, where LV<V1<V2<UV.

An additional feature can include a general speed range control means, which can be applied, for instance, when different size tracks are utilized, (eg. lower top speeds for smaller tracks). Further, any frequency range for communication between a remote controller and a car can be applied. For instance, a 2.4 GHz signal is more immune to noise than is a 75 MHz.

The present invention will be better understood by reference to the Detailed Description Section of this Specification, in combination with the Drawings.

SUMMARY OF THE INVENTION

It is therefore a purpose and/or objective of the present invention to provide means for disabling acceleration while maintaining remote control contact between a controller-miniature race car combination, such as by maintaining steering control.

It is another purpose and/or objective of the present invention to teach starting a competition between a plurality of miniature race cars by simultaneously enabling the accelerator control in the controllers in each of the controller-miniature race car combinations.

It is yet another purpose and/or objective of the present invention to teach ending, or temporarily interrupting, a competition between a plurality of miniature race cars by simultaneously disabling the accelerator control in the controllers in each of the controller-miniature race car combinations.

It is still yet another purpose and/or objective of the present invention to teach the terminating a specific contestant's ability to compete in a competition by selectively disabling his or her controller's ability to transmit accelerator control signals, if, for instance, said contestant is intentionally disrupting the competition.

It is yet still another purpose and/or objective of the present invention to teach use of a potentiometer in the acceleration control circuitry of a miniature race car controller which comprises a "dead-region".

It is yet still another purpose and/or objective of the present invention to teach use of a conventional potentiometer and a logic performing means in the acceleration control circuitry of a miniature race car controller to effect a "dead region".

Other purposes and/or objectives of the present invention will become apparent by a reading of the Specification and Claims.

DETAILED DISCLOSURE

Figure 1:
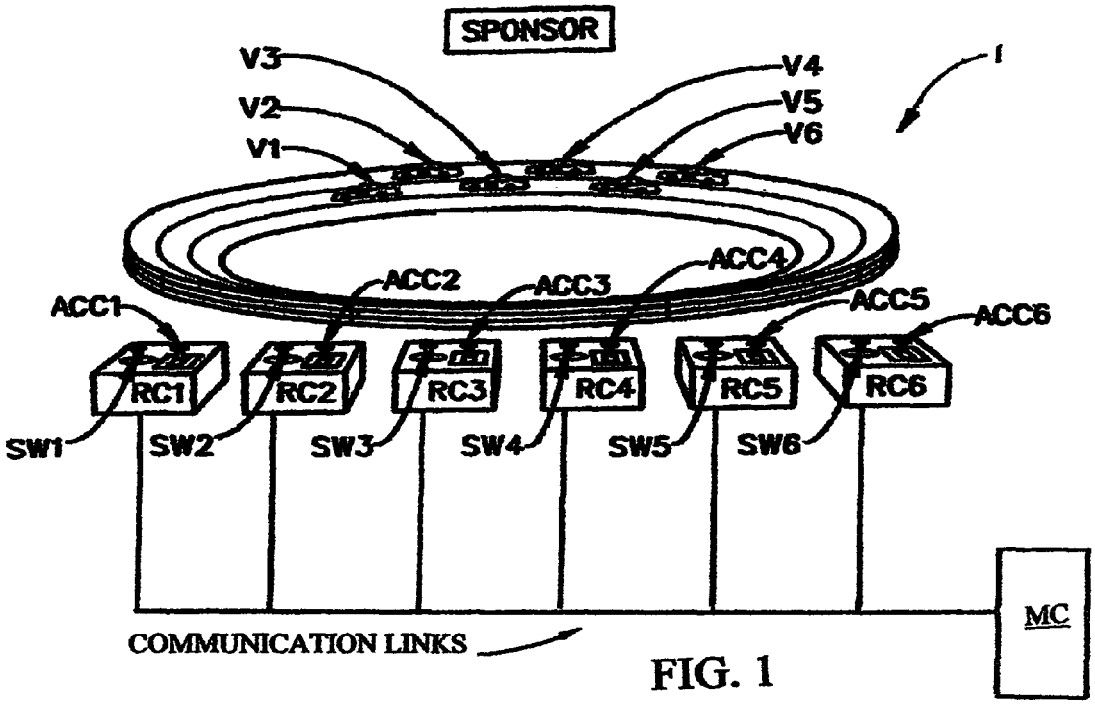
FIG. 1 demonstrates a system for practicing the method of the present invention.

To provide insight a Drawing of a System for Conducting a Competition (1), from U.S. Pat. No. 6,604,996 to the Inventors herein, is modified and provided as FIG. 1. Shown are Controllers (RC1) (RC2) (RC3) (RC4) and (RC5) which in use send control signals to miniature race cars (V1) (V2) (V3) (V4) and (V5) respectively. Added to the Drawing is indication of (COMM LINKS) and Master Controller (MC). Said FIG. 1 shows a competition in progress, but prior to said competition beginning the miniature race cars (V1) (V2) (V3) (V4) (V5) (V6) are lined up and are intended to be motionless. The present invention Master Controller (MC) achieves this by disabling the Accelerator Controls labeled (ACC1) (ACC2) (ACC3) (ACC4) (ACC5) (ACC6) in Controllers (RC1) (RC2) (RC3) (RC4) and (RC5) respectively, while leaving other signal transmission capability from the various Control Stations intact. While not limiting, this generally will mean that Steering Wheel (SW1) (SW2) (SW3) (SW4) (SW5) (SW6) control signal transmissions to a respective miniature race car (V1) (V2) (V3) (V4) (V5) (V6), are left operable. This approach prevents breaking lock-in between the various controllers and the cars they control, thereby opening the receivers in a miniature race car to spurious signals.

Note, while miniature cars are used as an example and shown in FIG. 1, vehicles of any shape, without limitation, can be used, (eg. truck, boot, boat etc.) The terminology "miniature race car" is to be interpreted to include any functionally shaped vehicle.

It is also to be understood that the Master Controller (MC) can include means to disconnect it from the (COMM LINKS) completely, and/or selectively disable a particular miniature race car if, for instance, the operator thereof is causing disruptions such as intentionally crashing his or her miniature race car into other miniature race cars etc. during a competition.

Figure 2A:
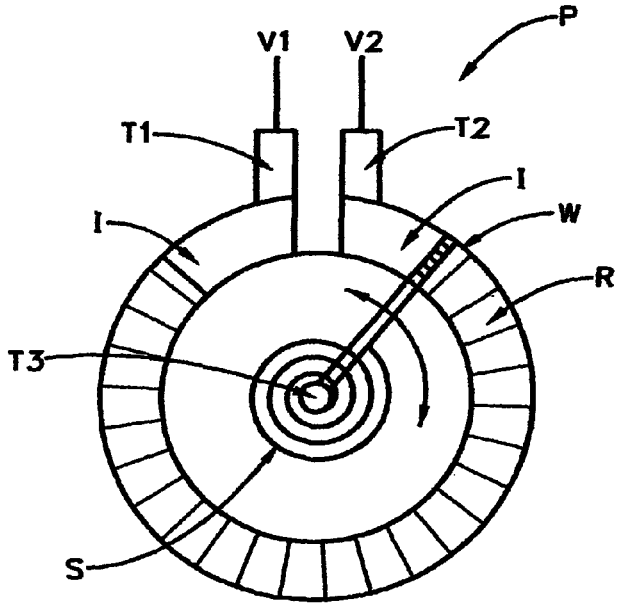
FIGS. 2*a* and 2*b* demonstrate potentiometers having a "dead-region", for use in acceleration control circuitry of present invention miniature race car controllers.

FIG. 2*a* shows function elements of a demonstrative Potentiometer (P) appropriate for use in a present invention system. Shown are Terminals (T1) and (T2) to which, in use, are applied Voltages (V1) and (V2). Note a Wiper (W) is electrically connected to a Terminal (T3). Also shown are Insulator (I) covered and open regions of Resistor (R). As the Wiper (W) is swept circularly along the Resistor (R) voltage at the Terminal (T3) varies. A present invention embodiment would provide a means to cause the Wipe (W) to return to the region of the Resistor (R) which is covered with Insulator (I) when not caused to be rotated by a user. The region of Insulator (I) provides a "dead-region". In the example used above, (V1) and (V2) can be set to provide −50 to +50 Volts. The region of the Insulator blocks −10 to +10 volts. That is, in this example, between −10 and +10 volts the potentiometer does not provide output. In more general terms the "dead-region" such that voltage is output thereby between −X to −Y and between +Y to +Z, where the absolute value of Y is greater than zero. A possible specific configuration of the potentiometer is to set V1 to a Positive Voltage, and V2 to (0.0) Volts, along with eliminating the Insulator adjacent to Terminal (T1).

Figure 2B:
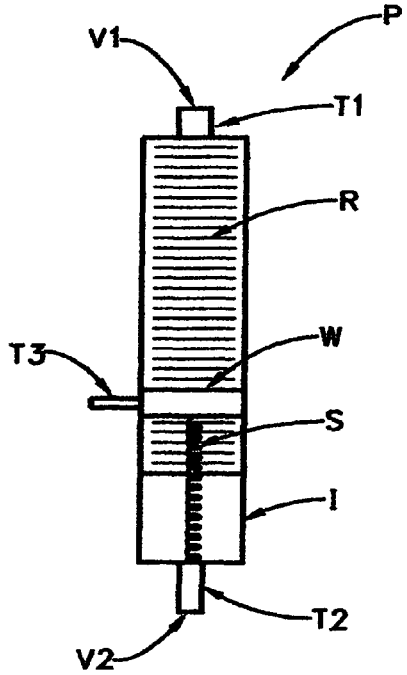

FIG. 2*b* shows elements of another design for a demonstrative Potentiometer (P') appropriate for use in a present invention system. Shown are Terminals (T1) and (T2) to which, in use, are applied Voltages (V1) and (V2). Note a Wiper (W) is electrically connected to a Terminal (T3). Also shown are Insulator (I) covered and open regions of Resistor (R). As the Wiper (W) is swept linearly along the Resistor (R) voltage at the Terminal (T3) varies. A present invention embodiment would provide a means to cause the Wipe (W) to return to the region of the Resistor (R) which is covered with Insulator (I) when not caused to be rotated by a user. The region of Insulator (I) provides a "dead-region". In the example used above, (V1) and (V2) can be set to provide −50 to +50 Volts. The region of the Insulator blocks −10 to +10 volts. That is, between −10 and +10 volts the potentiometer does not provide output. in more general terms the "dead-region" such that voltage is output thereby between −X to −Y and between +Y to +Z, where the absolute value of Y is greater than zero. A possible specific configuration of the Potentiometer (P') is to set V1 to a Positive Voltage, and V2 to (0.0) Volts, such that Wiper (W) detects 0.0 volts in the region in which there is present Insulator (I) near Terminal (T2).

Note that both Potentiometers (P) and (P') can comprise a Spring (S), as shown, which acts to return the Wiper (W) location to near Terminal (T2) when it is not forced toward Terminal (T1) by a user. In the context of the present invention, forcing the Wiper (W) toward Terminal (T1) corresponds to an acceleration signal being sent to a miniature race car. It is noted that the operation of such a Spring (S) does not always cause the Wiper (W) to return all the way to Terminal (T2), but where Insulator is present near thereto, the voltage at Terminal (T3), which electrically contacts the Wiper (W), will still provide (0.0) Volts.

Figure 2C:
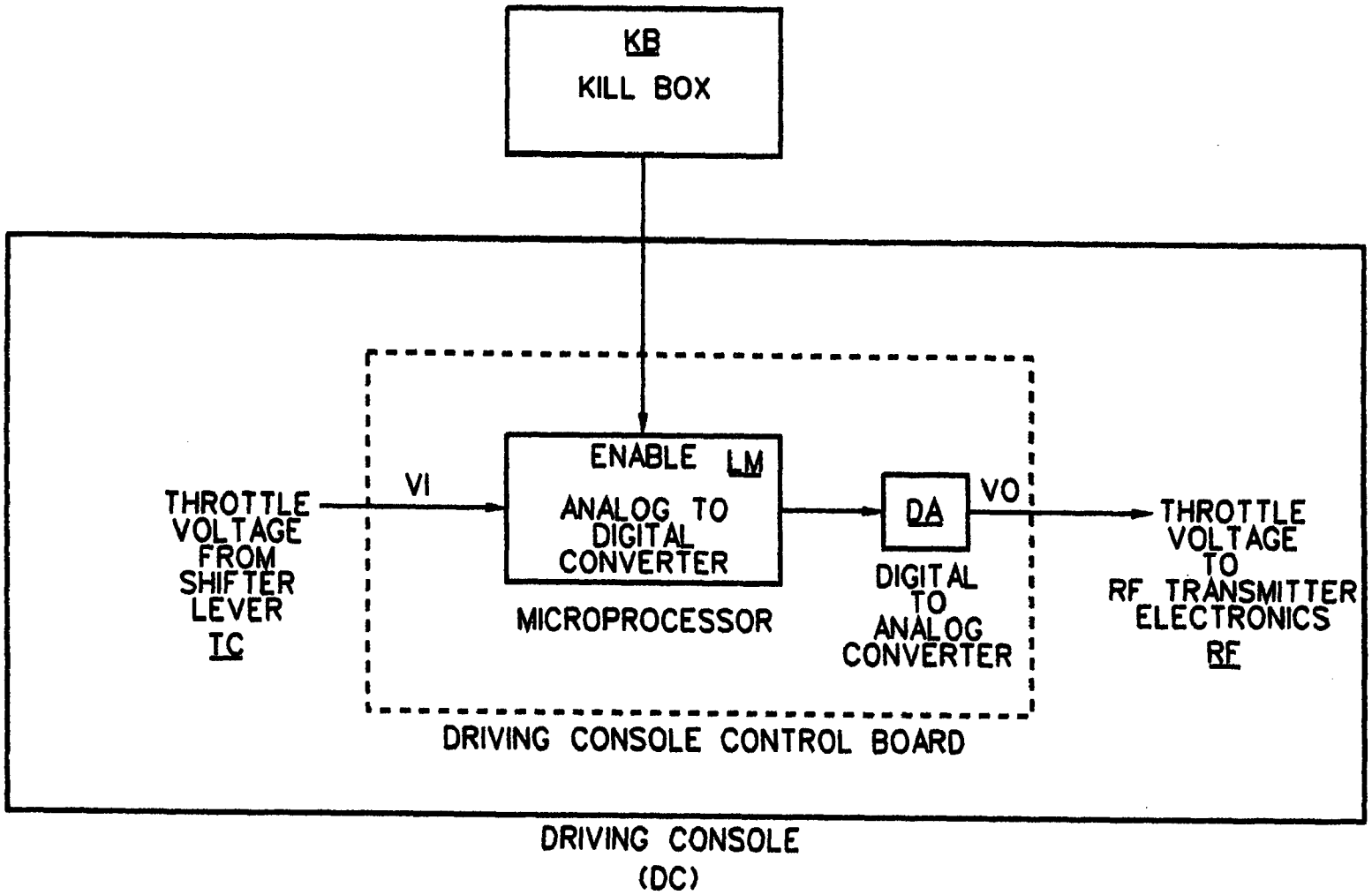
FIG. 2*c* shows a block diagram of a logic means based system for use in acceleration control circuitry of present invention miniature race car controllers.

FIG. 2*c*, demonstrates a block diagram of a present invention Driving Console (DC) system which utilizes a logic means, (eg. microprocessor), to achieve the goals of the present invention. Shown are Input Voltage (IV) from a Throttle Control (TC), (eg. a conventional potentiometer), a Logic Means (LM) and a "Kill Box" (KB). Note that the Logic Means (LM) receives input from the Throttle Control (TC) and Kill Box (KB) and provides output to a RF Transmitter. In this demonstrative embodiment the Logic Means (LM) performs an Analog to Digital conversion. An additional element (DA) is therefore shown to perform a Digital to Analog conversion of the output from said Logic Means (LM) prior to entering it, as Output Voltage (VO) to an RF Transmitter (RF). If the Logic Means (LM) is analog rather than a digital microprocessor, the (DA) is, of course, not required.

It is to be understood that the variable analog voltage provided at the output of a potentiometer can be applied in analog transmitter circuitry, or it can be converted into a digital signal and that converted signal applied in digital circuitry. The specific type and design of circuitry is not the focus in the present invention. Rather, the focus is the method of preventing selectively disabling acceleration controller capability while maintaining signal "lock-in" between controller and miniature race car combinations to prevent "glitch" actions of miniature race cars before a competition is started, and/or to simultaneously end a competition, and/or to selectively disable specific contestants who, for instance, are disrupting a competition by reckless activity.

For coordination, (ACC1) (ACC2) (ACC3) (ACC4) (ACC5) (ACC6) in FIG. 1 are Potentiometers such as described with respect to FIGS. 2*a* and 2*b*. The FIG. 1 (SW1) (SW2) (SW3) (SW4) (SW5) (SW6) are Steering Controls. Practice of the present invention provides that before and after a competition, a signal from the Master Controller (MC) disables transmission of signals which are controlled by (ACC1) (ACC2) (ACC3) (ACC4) (ACC5) (ACC6) to respective miniature race cars (V1) (V2) (V3) (V4) (V5) and (V6); but leaves intact transmission of signals controlled by (SW1) (SW2) (SW3) (SW4) (SW5) (SW6) and respective miniature race cars.

Figure 3:
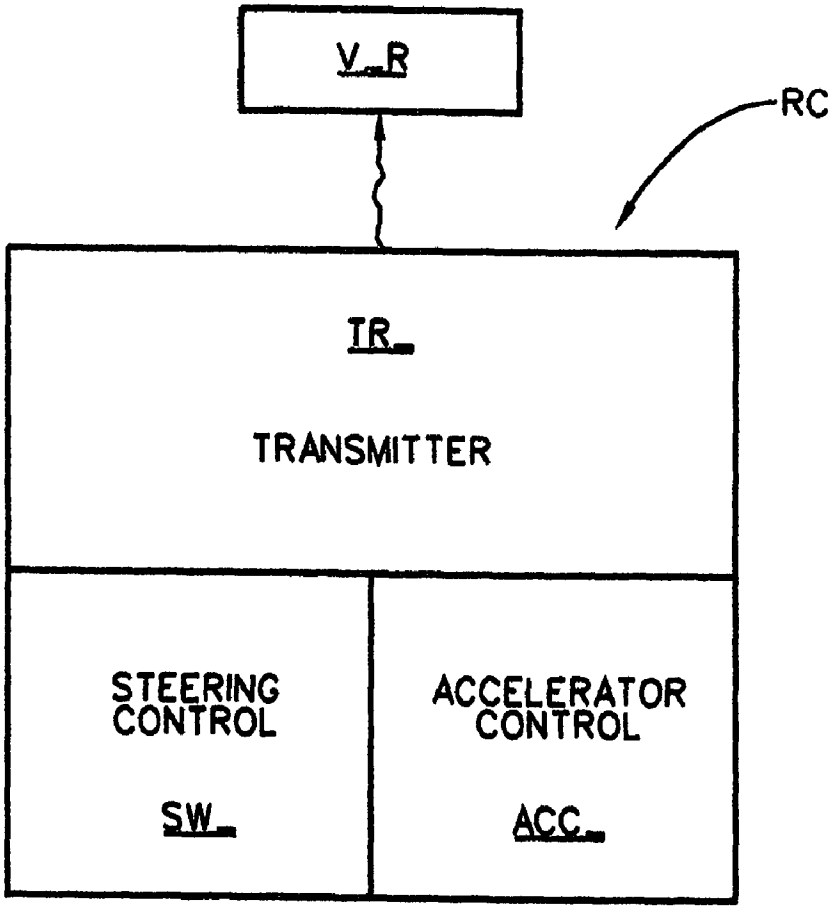
FIG. 3 demonstrates, in a demonstrative block functional manner, components of a Controller (eg. (RC1) (RC2) (RC3) (RC4) & (RC5).

FIG. 3 demonstrates, in a demonstrative block functional manner, components of a Controller (eg. (RC1) (RC2) (RC3) (RC4) & (RC5). Shown as present are Accelerator Controls labeled (ACC1) (ACC2) (ACC3) (ACC4) (ACC5) (ACC6), and Steering Wheel Controls (SW1) (SW2) (SW3) (SW4) (SW5) (SW6). It should be appreciated that it is not the specific circuitry in a controller Transmitter (TR_) or miniature race car Receiver (V_R) which distinguishes the present invention, but rather the technique of maintaining remote control connection therebetween, (eg. a completed steering (SW_) circuit), while disabling the Acceleration Control (ACC_) before a competition is initiated, and/or at the end of a competition and/or when a contestant is intentionally disrupting other contestants. Maintaining the locked-in circuit between a controller (RC_) and a corresponding miniature race car Receiver (V_R) prevents the Receiver (V_R) therein from latching onto spurious random signals and moving as a result.

It is to be understood that (MC) in FIG. 1 and (KB) in FIG. 2*c* can utilize any functional communication link including cable, RF, remote control etc. Further, the terminology "miniature race cars" is to be interpreted sufficiently broad so as to include a vehicle of any functional shape. That is, for instance, a vehicle shaped like a truck or tank or even a boot, is within the scope of said terminology. Because of this, in the Claims the terminology "vehicles" is used.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

The invention claimed is:

1. A method of conducting a competition involving a plurality of miniature race vehicles in which both steering and acceleration thereof are controlled via transmitting wireless radio signals to receivers therein, said method including preventing unintended action of said miniature race vehicles resulting from receipt of spurious acceleration controlling wireless radio signals by always maintaining a locked-in circuit between a controller and a receiver in a miniature race vehicle controlled thereby, comprising the steps of:

a) providing a plurality of radio remote controlled miniature race vehicles, each having an individual controller associated therewith, which associated controllers are capable of transmitting wireless radio signals to control, separately, the steering and acceleration of an associated miniature race vehicle, each of said receivers being characterized in that receipt of a steering control signal from the miniature race vehicle associated transmitter provides immunity to receipt of spurious acceleration control signals from sources other than said associated transmitter;

b) from a master control means sending the individual controllers a signal which, while the miniature race vehicles are in a starting position, disables the wireless radio acceleration control but maintains wireless radio communication between the controller and the phrase the miniature race vehicle associated miniature race vehicle steering control;

c) upon the start of a competition enabling said wireless radio acceleration control in each controller-miniature race vehicle combination, from said master control means;

wherein the miniature race vehicle miniature race vehicle in a starting position does not move forward or backward because the locked-in circuit between a controller and a miniature race vehicle receiver controlled thereby is not broken, thereby preventing spurious acceleration signals from gaining entry to said miniature race car receiver.

2. A method as in claim 1, which further comprises a timer which is triggered by the master control means when it sends the controllers in controller-miniature race vehicle combinations a signal to enable the wireless radio acceleration control, which timer counts down to an automatic end of the competition, at which end of competition time said master controller disables the wireless radio accelerator control in the controllers in each of the controller-miniature race vehicle combination.

3. A method as in claim 1, which further comprises disabling the wireless radio accelerator control in a particular miniature race vehicle during a competition.

4. A method of conducting a competition involving miniature race vehicles in which both steering and acceleration thereof are controlled via transmitting wireless radio signals to receivers therein, said method including preventing unintended action of said miniature race vehicles resulting from receipt of spurious wireless radio signals by always maintaining a locked-in circuit between a controller and a receiver in a miniature race vehicle controlled thereby, comprising the steps of:

a) providing a plurality of radio remote controlled miniature race vehicles, each having an individual controller associated therewith, which associated controllers are capable of transmitting wireless radio signals to control, separately, the steering and acceleration of an associated miniature race vehicle, each of said receivers being characterized in that receipt of a steering control signal from the miniature race vehicle associated transmitter provides immunity to receipt of spurious acceleration control signals from sources other than said associated transmitter;

b) providing a master control means for sending the individual controllers a signal which disables the wireless radio acceleration control while allowing continued wireless radio communication between the controller and its associated miniature race vehicle steering control;

c) enabling said wireless radio acceleration control in each controller-miniature race vehicle combination from said master control means such that a competition can take place;

d) during said competition disabling the wireless radio acceleration control of at least one controller, wherein the miniature race vehicle associated therewith is disabled.

5. A method as in claim 4, which further comprises pausing a race by disabling the wireless radio acceleration control of all controllers.

6. A method as in claim 4, which further comprises imposing a maximum car speed which all wireless radio acceleration controllers can cause.

* * * * *